US006872020B2

(12) United States Patent
Epli

(10) Patent No.: US 6,872,020 B2
(45) Date of Patent: Mar. 29, 2005

(54) SCREW CAP WITH A BRUSH

(76) Inventor: Susanne Epli, Oberdorfstrasse 24, 73066 Uhingen (DE)

( * ) Notice: Subject to any disclaimer, the term of this patent is extended or adjusted under 35 U.S.C. 154(b) by 0 days.

(21) Appl. No.: 10/257,972

(22) PCT Filed: Mar. 19, 2001

(86) PCT No.: PCT/EP01/03105

§ 371 (c)(1),
(2), (4) Date: Jan. 17, 2003

(87) PCT Pub. No.: WO01/70589

PCT Pub. Date: Sep. 27, 2001

(65) Prior Publication Data

US 2003/0147685 A1 Aug. 7, 2003

(30) Foreign Application Priority Data

Mar. 20, 2000 (DE) ..... 200 05 231
Aug. 25, 2000 (DE) ..... 200 14 730

(51) Int. Cl.[7] ..... A46B 11/00
(52) U.S. Cl. ..... 401/127; 401/129
(58) Field of Search ..... 401/118, 126–130

(56) References Cited

U.S. PATENT DOCUMENTS 4,990,014 A * 2/1991 O'Neill ..... 401/127
5,096,320 A * 3/1992 Norman et al. ..... 401/127
5,690,441 A * 11/1997 McManus ..... 401/127
5,913,631 A * 6/1999 Landry ..... 401/127
5,947,622 A * 9/1999 Akyildiz et al. ..... 401/129
6,164,857 A * 12/2000 Wolfarth-Brooks et al. 401/127
6,572,296 B2 * 6/2003 Schrepf ..... 401/122

FOREIGN PATENT DOCUMENTS

| | | |
|---|---|---|
| CH | 173779 | 12/1934 |
| DE | G104220.8 | 6/1991 |
| DE | 4404869 A1 | 8/1995 |
| DE | 29702226 U1 | 8/1997 |
| DE | 29910015 U1 | 9/1999 |
| GB | 239461 | 9/1925 |

* cited by examiner

*Primary Examiner*—Tuan Nguyen
(74) *Attorney, Agent, or Firm*—Bacon & Thomas

(57) ABSTRACT

A little bottle with a cap which can be mounted via a screw-type cap has an integrated brush for removing the mainly liquid contents of the little bottle. In order to be able to mainly remove the entire contents from the little bottle in a simple way with the integrated brush, it has been planned that, In combination, the brush in the cap is held in such a way that it can be moved in axial direction, and the interior space of the little bottle has a hollow near the bottom of the little bottle, which is at least partially opposite to the free end of the removal element.

4 Claims, 6 Drawing Sheets

SCREW CAP WITH A BRUSH

FIELD OF THE INVENTION

The present invention concerns a little bottle with a cap or with a cap that can be mounted via a screw plug or a bayonet fixing which is equipped with an integrated element like e.g. a brush or a pipette in order to remove the contents of the little bottle which are mainly liquids.

BACKGROUND OF THE INVENTION

For example in the cosmetics sector, very small bottles are used from which the contents, like e.g. nail varnish are removed in portions or charges with a brush which has been mounted to the interior of the screw cap, and then, the contents are applied to the object, e.g. the finger nail. In other areas, like e.g. in order to apply correction liquid to paper, such screw caps with an integrated brush are used. Another area of application are medical bottles like e.g. those for nose drops for which a pipette has been integrated into the screw cap.

For such caps (screw cap or bayonet fixing cap) which have been equipped with a moving element (brush, pipette or similar) there is the problem that the brush or the pipette end only reaches the bottom of the little bottle if the cap has been mounted onto the little bottle so that, with the cap removed, the removing element end has a certain distance to the bottom of the little bottle. This means that a certain residual amount cannot be removed from the little bottle. Thus one tries to remove more of the contents from the little bottle by inclining the little bottle with the removable element emerged. In order to achieve this, the person doing so must not only have a certain skilfulness, but this process is also rather tedious.

The purpose of the present invention is thus to change a little bottle with an attachable cap of the previously mentioned way in such a way that, with the integrated removing element, mainly the entire contents can be removed from the little bottle in a simple way.

SUMMARY OF THE INVENTION

In order to solve this problem, such a little bottle with an attachable cap of the previously mentioned way is to be equipped with an integrated element for removing the mainly liquid contents of the bottle like, e.g., a brush or a pipette, distinguished by the fact that, in combination, a removal element in the cap is retained in an axially removable way and that the interior space of the bottle has a hollow region in the direction of the bottom of the bottle which is at least partially opposite to the free end of the removal element.

Due to the measures in accordance with the invention one not only achieves that the free end of the removal element like, e.g., the front end of the brush or the opening of a pipette can continue to reach the bottom of the little bottle with the cap screwed off but also that the remaining contents of the little bottle will flow together at a certain entire space area and can thus be detected without further tricks from the free end of the removal element. Due to this lowering of the removal element with respect to the cap and into a hollow region in the bottom of the little bottle, the contents of the little bottle can mainly be removed completely.

The shape of the hollow region may differ, among other things, this may depend on whether the body of the little bottle is cylindrical or angular. With the hollow region formed by a conical end or by the upside down pyramid-shaped end of the interior space of the bottle, an advantageous shape of the hollow has been reached. According to the fact that the hollow region is formed by a concave cavity which is directly or indirectly connected via one or various inclined areas to the sidewall or walls of the bottle, the hollow region may be directly at the axis centre of the bottom of the little bottle or it may extend over the sidewall.

If that removal element has been precisely aligned in axial direction, it is used in order to achieve the fact that the hollow region is symmetrical with reference to the axis of the movable removal element.

According to the fact that the removal element between a normal use end position and a residual use end position can be moved step-lessly in the axial direction where the axial path approximately equals the depth of the hollow region or the depths of the removal path of the cap from the bottle or equals the sum of both paths, and/or the fact that the removal element in the normal use position and/or in the residual use final position moved in the axial direction can be determined, the adjustment of the removal element in axial direction or the extension of the removal element with respect to the cap can be adjusted step-lessly or by the two final positions, in the latter case, a blocking of a special residual use end position in an advantage. The amount of the mobility in axial direction depends on the fact whether the residual contents with the removal element adjusted in axial direction are already to be detected with the cap attached and to be removed after the cap has been detached or whether the residual contents are only to be detected with the cap detached and are to be removed at the same time.

Advantageous designs concerning the axial mobility of the removal element (brush, pipette) are obtained via the fact that the removal element in the cap can be moved contrary to the effects of a compression spring, or the fact that the removal element is held by a push-button which can be removed in the axial direction in the cap, or the fact that the removal element is held by a rocker arm received in an articulated way in the cap, or the fact that the removal element is held by a turning knob received in a turntable way by the cap.

In an advantageous way, the actuating end of the removal element can be embedded into a recess in the cap which does not point in the direction of the bottle and which make it possible to maintain the dimensional proportions between the little bottle and the cap in the known way.

BRIEF DESCRIPTION OF THE DRAWINGS

For further details concerning the inventions, see the following description which describes the inventions in detail in accordance with the execution examples given in the drawing. The following is represented.

DESCRIPTION OF THE PREFERRED EMBODIMENTS

Figure 1A:
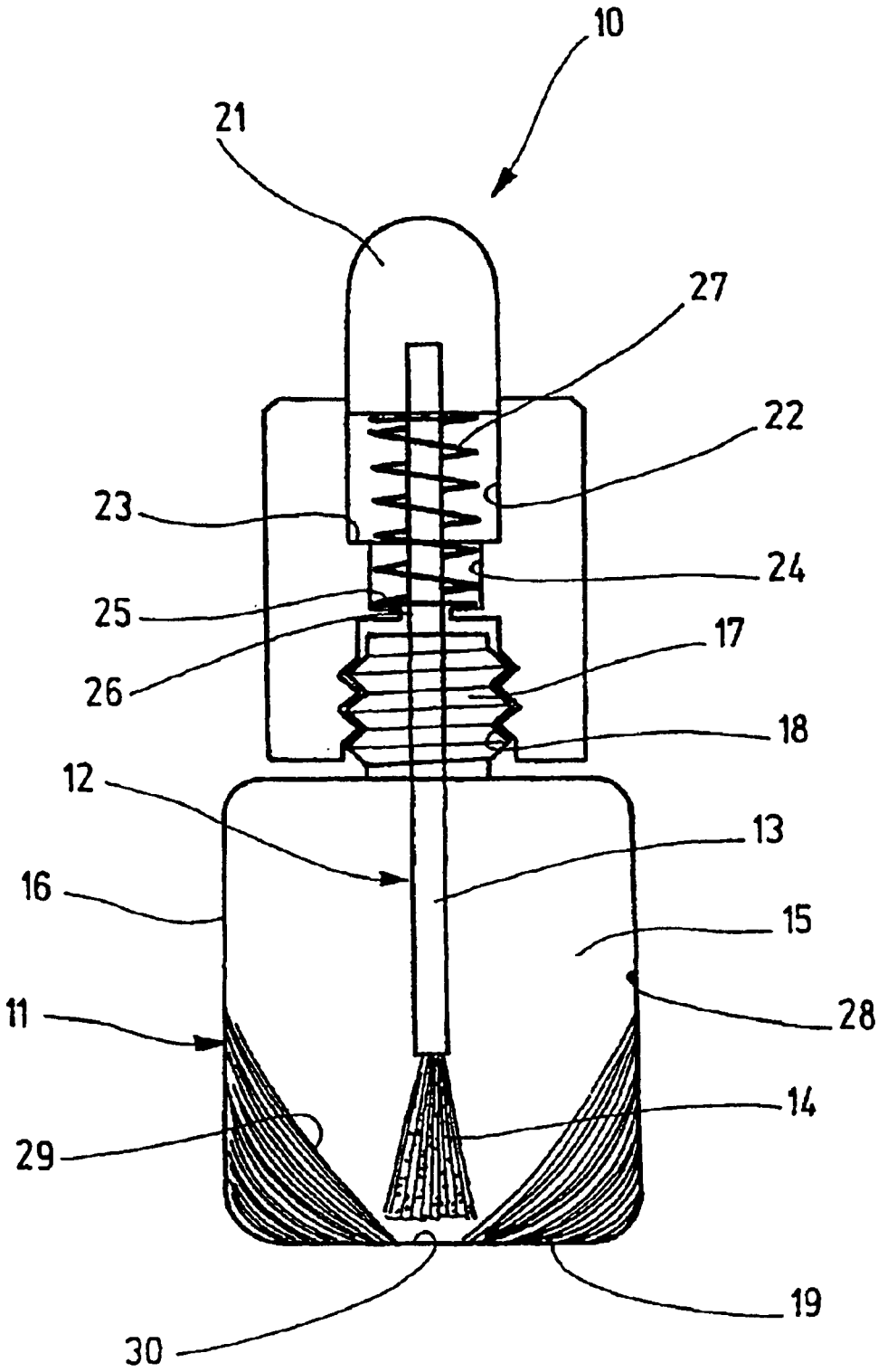
FIGS. 1A and 1B show, in a schematic representation with a longitudinal section, a little bottle with a cap and an integrated brush according to the first execution example of the present invention in the normal use representation or in the residual use end position of the brush.

The execution examples given in the drawing of the present invention show a little bottle 11 or 11' which has been equipped with a screw cap 10, 10' or 10" which has been equipped with a removal element in the shape of a brush element 12 which is held in the screw cap 10, 10' or 10" in such a way that it can be moved in axial direction with respect to the screw cap and the little bottle 11 between the first or the initial position or the normal use position and a second end position or a residual use position. The little bottle 11 contains e.g. nail varnish which can be removed in portions or in charges with the brush element 12 and which can be applied to the individual finger or toe nails.

In the examples given here, the little bottle 11, 11' has an external thread neck 17 on its body 16, 16', onto which the screw cap 10, 10' or 10" with its internal thread recess 18 can be screwed. The body 16, 16' of the little bottle 11, 11' which can either be round or square has a hollow 15 for receiving the contents which points to the bottom 19 and which has been equipped with a hollow 30 which is used for collecting the residual contents in the little bottle which becomes more and more empty.

In the case of the given example, the hollow 30 is axial and has been arranged in a symmetrical way around the axis. The hollow 30 passes over into conical areas 29, 29' in this example, which are more (FIG. 1) or less (FIG. 2) steep with respect to the cylindrical sidewall 28 or to the various sidewalls of a square bottle cross section. The only further difference between the bottle 11 of the FIGS. 1A and 1B and the little bottle 11' of the FIGS. 2A and 2B is the fact that the body 16 of the little bottle 11 is shorter than the body 16' of the little bottle 11'. The brush element 12 which can continuously be moved in axial direction in the screw cap 10, 10' or 10" has a rod 13 which is aligned in axial direction and whose rear end has been fixed to an operation element 21, 21' or 21 in or at the screw cap 10, 10' or 10" and to whose front end a brush 14 has been mounted.

Figure 1B:
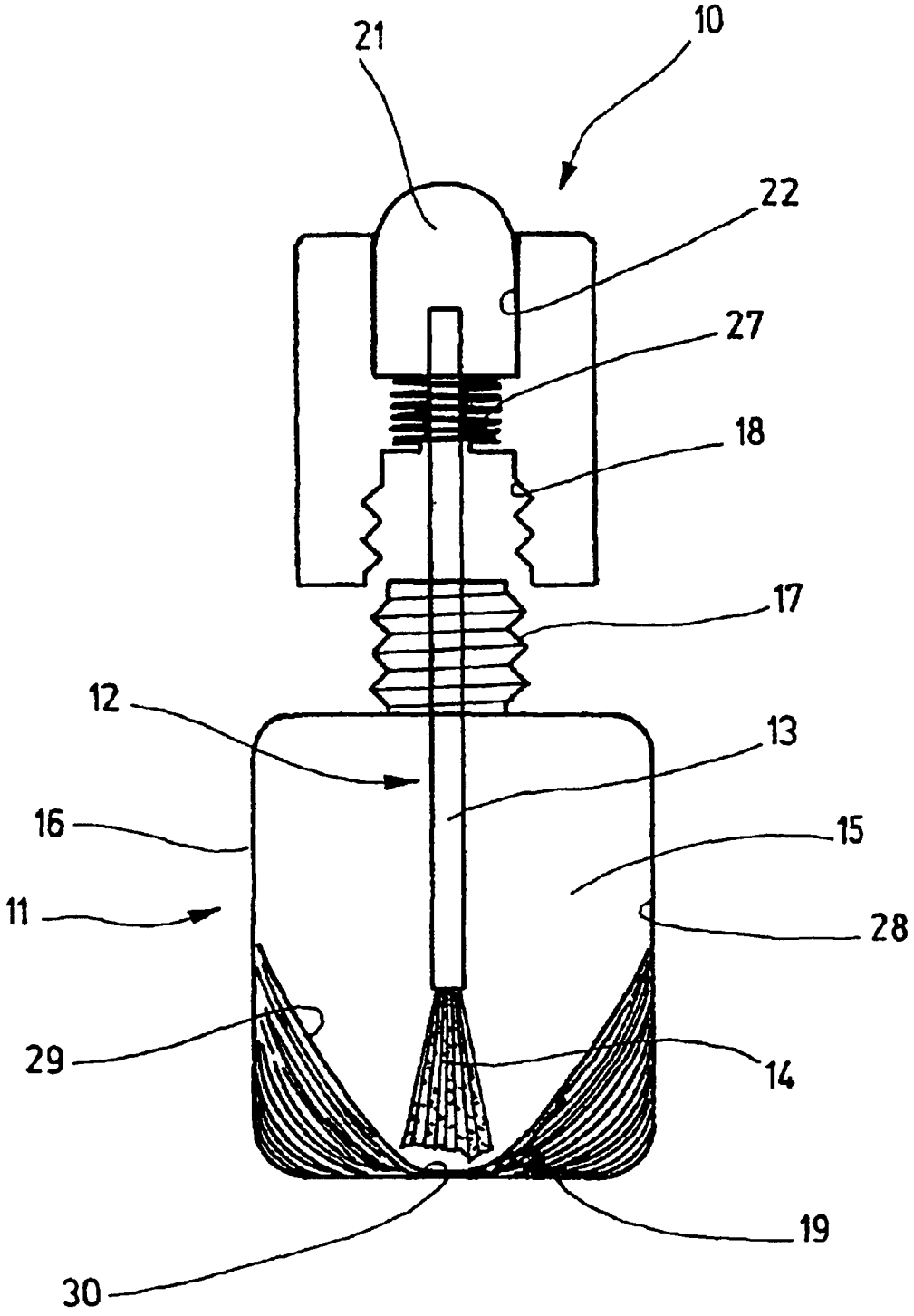
Figure 2A:
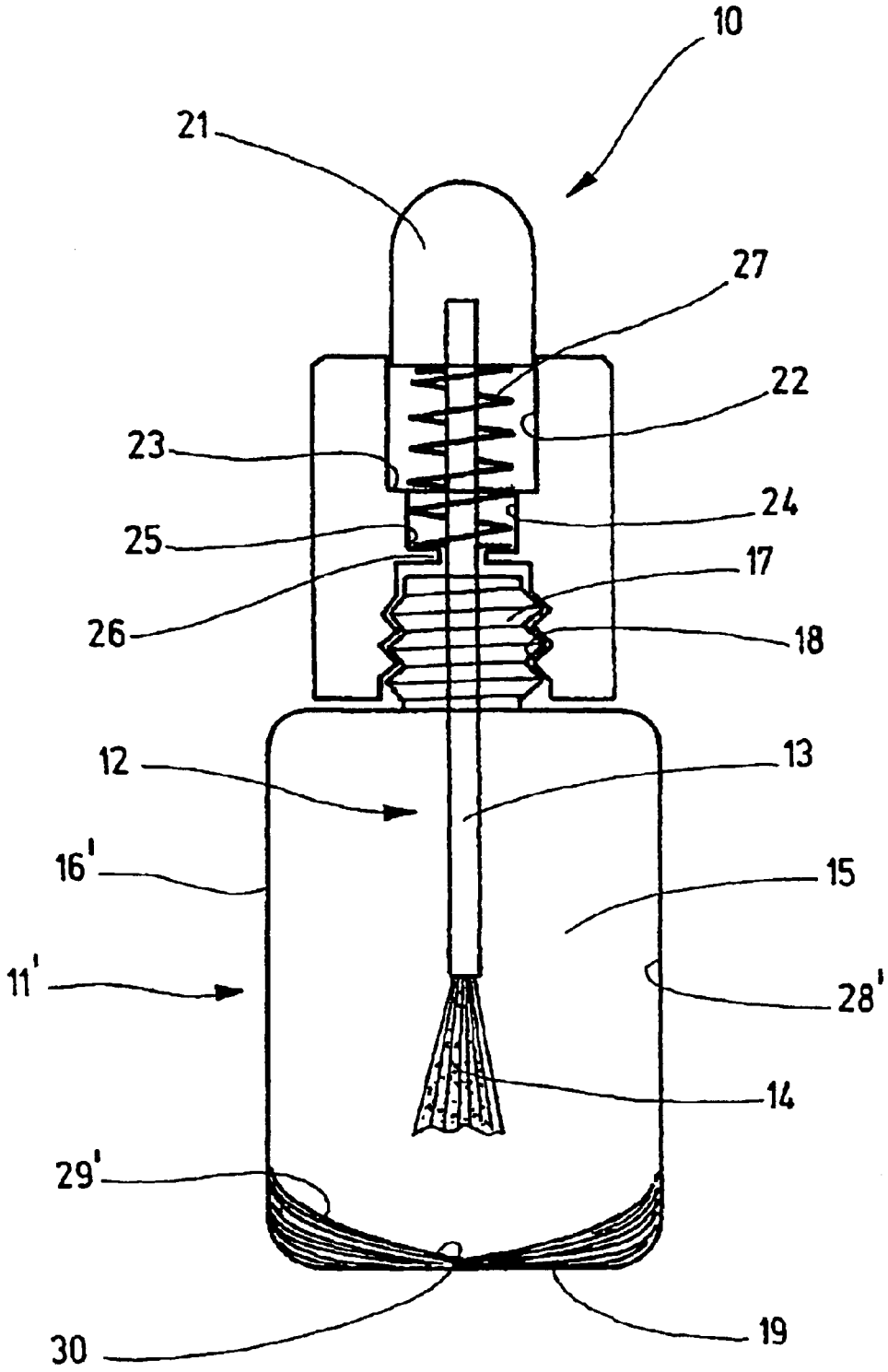
FIGS. 2A and 2B show a representation in accordance with the FIGS. 1A and 1B, but according to a second execution example.
Figure 2B:
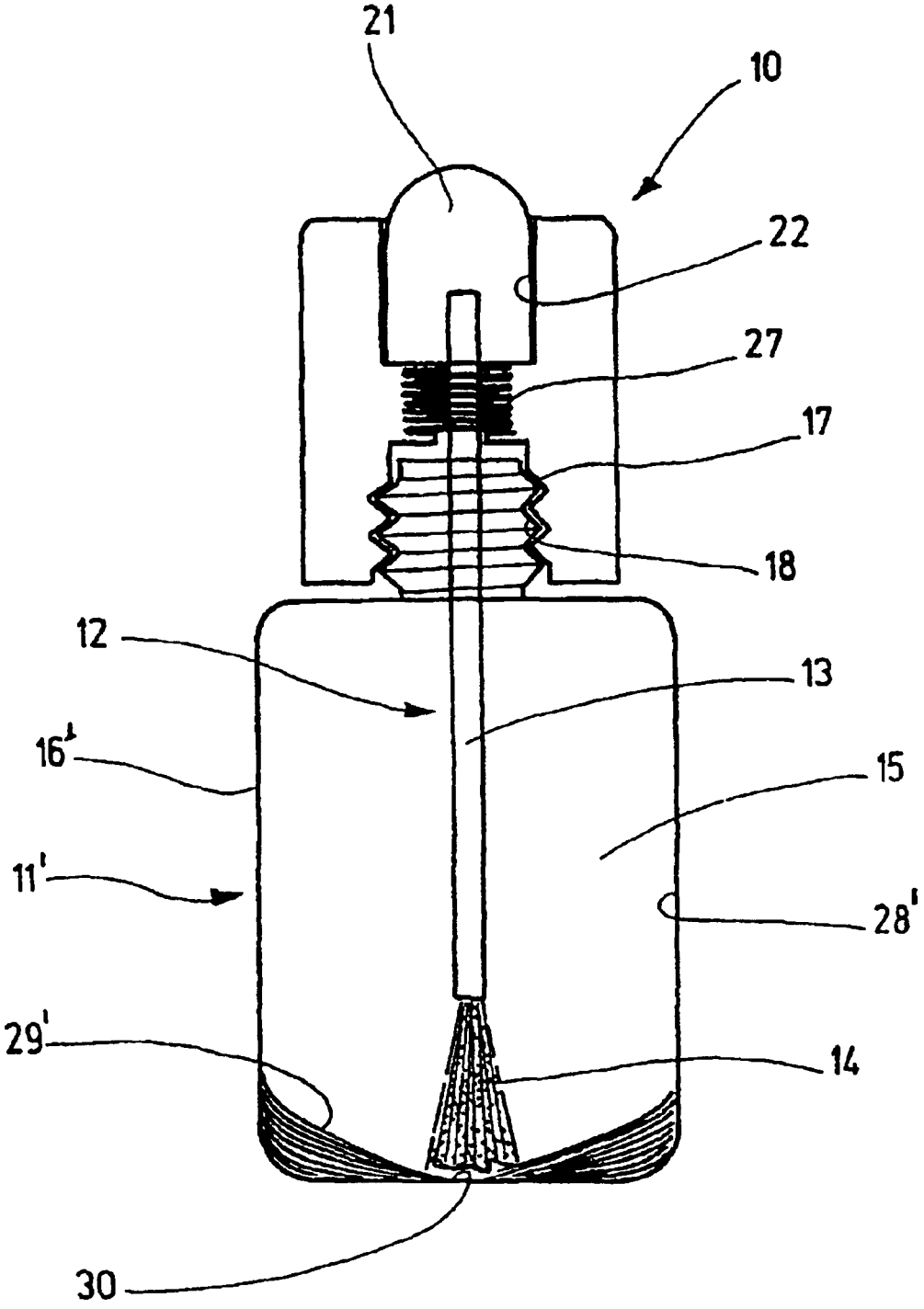

In the examples given in the FIGS. 1A, 1B and 2A, 2B is the rear end of the rod 13 which has been fixed to an operation knob 21 which can be moved in axial direction within a concentric rear cylindrical reception 22. The reception 22 has a first shoulder 23 at its inner end, parallel to which a second shoulder 25 has been provided for in a second reception 24 with a smaller diameter. This second shoulder 25 is surrounded by an opening 26 for the rod 13 of the brush element 12. The lower side of the second shoulder 25 is formed by a ring gasket surface, which is seated on the ring front surface of the external thread neck 17 of the little bottle 11 in a sealing way, which is not shown in detail, in accordance with FIGS. 1A, 1B and FIG. 2A with the little bottle 11, 11' closed. The rear end of rod 13, which points in the direction of knob 21, is surrounded by a pressure spring 27, which is, on one side, supported by the interior of the knob 21 and, on the other side, supported by the second shoulder 25. The first shoulder 23 is used as an end stop for the interior of the knob 21 in the residual use final position of the brush element 12. In the first execution example FIG. 1A shows the initial position or the normal use end position of the brush element 12 held at the screw cap 10. In this position, the free brush end 14 of the brush element 12 slightly exceeds the bottom 19 of the little bottle 11. For this normal end position of the brush element 12, it is possible with the screw 10 removed from the little bottle 11 to remove the contents of the little bottle 11 with the aid of the brush 14 up to a certain residual filling level which approximately corresponds to the length of the screw-thread lock.

If the residual filling level does not reach this mark, the brush element 12 is moved in axial direction with relation to the screw cap 10 opposed to the effects of the pressure spring 27 according to FIG. 1B with the screw cap 10 removed from the little bottle 11. The end position which represents the residual use end position has been reached if the head 21 touches the first shoulder 23 with its inner side. This makes the brush element 12 move with relation to the screw cap 10 by an amount which is larger or equal to the length of the lock thread. In this residual use final position, it is possible that the brush end 14 of the brush element 12 reaches the bottom of the hollow 30 at the floor 19 of the little bottle 11 for removing residual liquids in the emerged state in accordance with FIG. 1B.

In the examples given in FIGS. 2A and 2B where the body 16' of the little bottle 11' is a little shorter the free end of the brush element 12 is in the normal use end position at a distance to the bottom of the hollow 30 at the bottom 19 of the little bottle 11' whose distance is approximately the path of the axial movement of the brush element 12 with the knob 21 pressed. If the knob has been pressed, the brush element 12 is transfered from its normal use end position given in FIG. 2A to its residual use end position given in FIG. 2B, with the cap 10 still screwed off.

In this example, thus residual contents of the liquid in the hollow 20 of the little bottle 11' are detected with the cap 10 still screwed off, as a result, the cap 10 can be screwed off and the liquid can be applied to a finger nail or anything like that with a brush. This design is e.g. of an advantage if the removal element is a pipette.

For these two previously mentioned examples, the movement of the brush element 12 in axial direction or the so-called extension of the brush element 12 with relation to the screw cap 10 is reached by pressing the knob 21 and is stopped there. When removing the pressure on knob 21, the brush element 12 returns to its initial or normal use end position due to the functioning of the pressure spring 27 so that the screw cap 10 can be screwed back onto the little bottle 11, 11' without the brush end 14 and reaches the bottom 19 of the little bottle 11. It is also possible of course, however, to block the residual use end position in a releasable way.

Figure 3A:
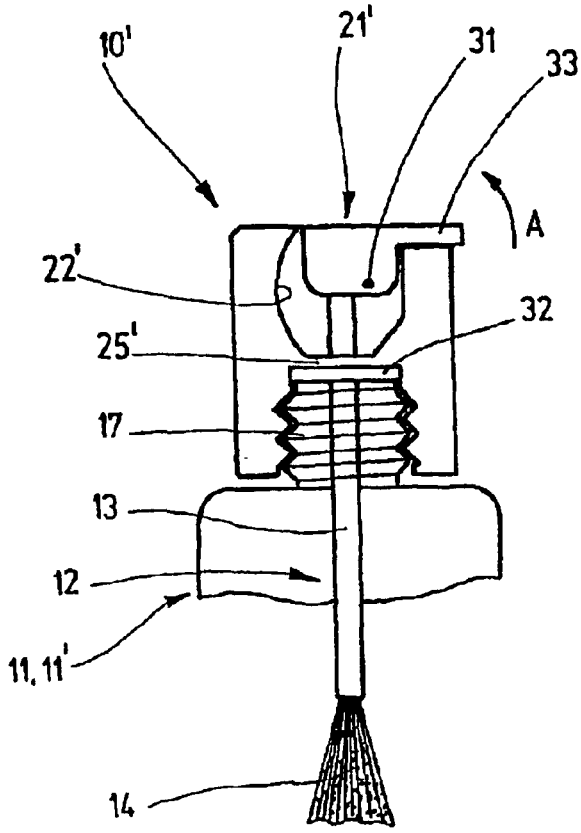
FIGS. 3A and 3B show a representation in accordance with the FIGS. 1A and 1B, but only with a suggested little bottle or without a little bottle and in accordance with a third execution example and FIGS. 4A and 4B a representation in accordance with FIGS. 3A and 3B, but only in accordance with a fourth execution example.
Figure 3B:
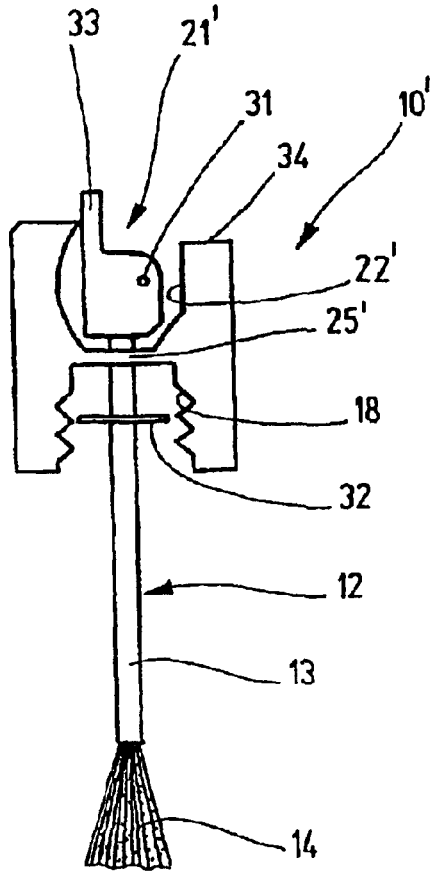

The third example given in the FIGS. 3A and 3B for which the little bottle 11 or 11' with the hollow 30 which has been described beforehand is used, but which is only represented partially or not at all, differs from the examples according to the FIGS. 1A, 1B and 2A, 2B by the actuation elements 21' used for the axial brush element movement. The actuating element 21' is formed by a rocker arm which can be swivelled around an axis 31 fixed to the screw cap 10' in the reception 22' of the screw cap 10'. The end of the rod 13 of the brush element 12 is carried in a swivellable way by the rocker arm 21' (not shown) eccentric to the axis 31 so that, when swivelling the rocker arm 21' with relation to the screw cap 10', the brush element 12 or its rod 13 moves in axial direction.

The rod 13 of the brush element 12 penetrates a bore in an intermediate wall 25' and has a sealing element 32 which is to be laid on the external thread neck 17 of the little bottle 11. It is also possible to equip the rocker arm 21' with a main driving link onto which the rod 13' is pressed in a spring-elastic way and which moves the rod during the swivelling movement.

In the initial or normal use end position according to FIG. 3A, the rocker arm 21' has been swivelled in together with its handling 33 in an axial groove 34 of the screw cap 10' on the circumferential side. If this handling 33 is swivelled in the direction of the arrow A in upside direction, the rod 13 moves with relation to the screw cap 10' in axial direction due to the eccentricity of the swivelling axis 31 of the rocker arm 21' and the screw cap 10' with relation to the hinge axis between rod 13 and rocker arm 21' in such a way that an extension of the brush element 12 or an extension of the distance of the brush 14 of the brush element 12 to the lower screw cap at 10' result (FIG. 3B). In this example, the two final positions (upper normal use end position and lower residual use end position according to FIG. 3B) have been determined or locked.

Figure 4A:
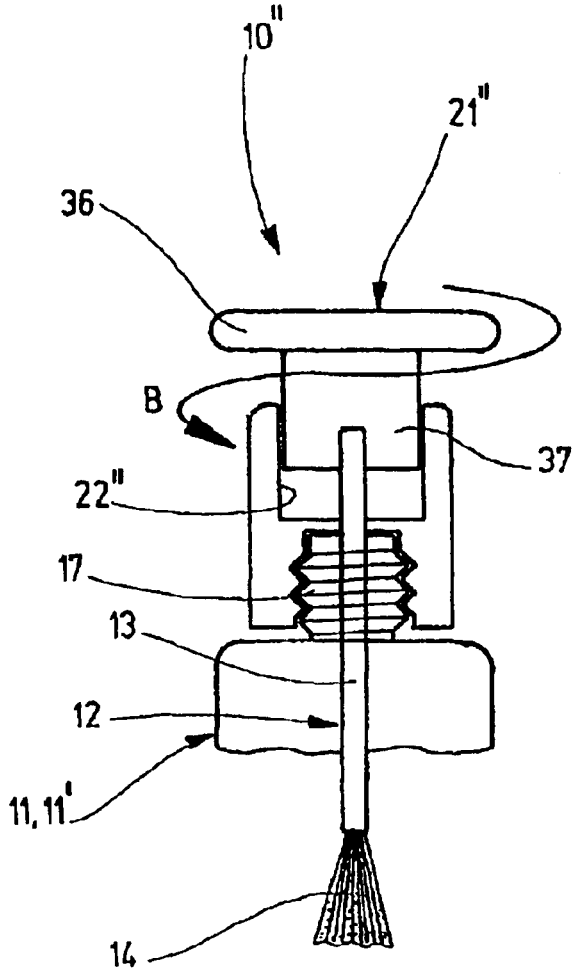
Figure 4B:
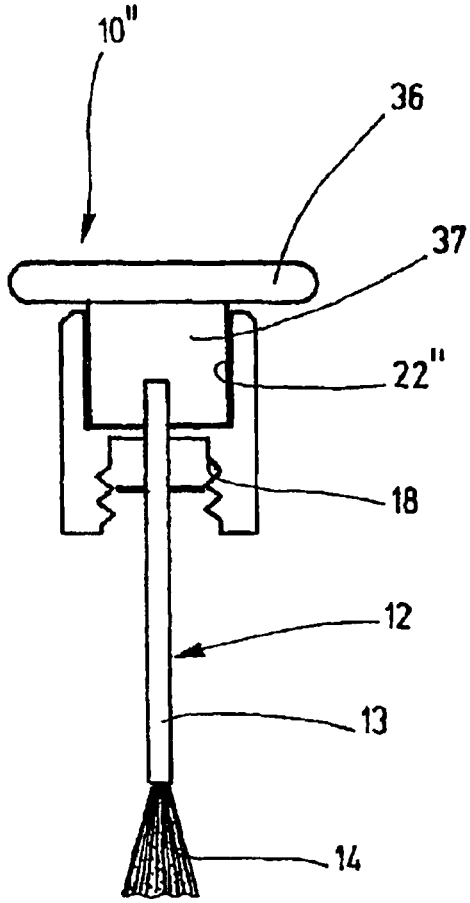

In the fourth example according to FIGS. 4A and 4B which also shows the used little bottle 11, 11' only partially or not at all, the actuation element 21" is formed by a screw element at the inner end of which the rod 13 of the brush element 12 has been fixed. The screw element 21" is held by a relatively steep thread, which is not represented individually, made of e.g. a single thread in the reception 22" of the screw cap 10".

A journal 37 of the screw element 21" is equipped with an external thread, where a plate 36 which is used as a handling on the outside together with the journal 37 is carried out as one piece. Of course, the reception 22" of the screw cap 10" is equipped with a corresponding internal thread. For example, the reception 22" has an opening (milled) which runs in spirals of approx. 90° around the cap. In the lower part (journal 37) of the actuating element 21", a pin has been inserted which, on the one hand, is securely seated in that journal 37 and, on the other hand, is in the mentioned opening. If the actuating element 21" is turned now, the desired brush element movement in axial direction is generated.

Due to a screw movement in direction of the arrow B, it is possible to move the turning element 21" from its normal use end position represented in FIG. 4A to a residual use end position represented in FIG. 4B in which, as shown in the previous examples, an extension of the brush element 12 or an increase of the distance of the brush end 14 from the lower screw cap edge 10" results. Here, too, both end positions are fixed.

According to a further execution example of the present invention (not shown), the actuating elements can be formed in the way of a lockable push-button mechanism used by pens.

In accordance with further, not shown examples for the present invention, the screw cap does not have a brush element 12, but a pipette element, which is held in a screw cap in such a way that it can be moved in axial direction and which can thus be extended in such a way that the distance of the pipette to the lower edge of the screw cap can be changed. Here, it is possible to use the constructions or mechanisms shown by drawings in the examples. It is understood that the hollow 30 for collecting the residual fluid can also have various shapes.

What is claimed is:

1. A small bottle having:

a cap with an integrated removal element for removing mainly liquid contents of said small bottle, said cap being fitted to said small bottle by one of a screw-type connection and a bayonet-type connection, said removal element of the cap is retained in an axially removable way and an interior space of the small bottle has a hollow region at a bottom of the small bottle, which is at least partially opposite to a free end of said removal element, the hollow region is formed by one of a conical end an upside down pyramid-shaped end of the interior space of the small bottle, and said removal element is held by one of a push-button mechanism which can be locked and released in the cap when axially moved and a rocker arm received in an articulated way in the cap, such that length of said removal element in said small bottle can be varied.

2. The small bottle as claimed in claim 1, wherein said hollow region is symmetrical with reference to the axis of said removal element.

3. The small bottle as claimed in claim 1, wherein said removal element is positioned between a normal use end position and a residual use end position, said removal element can be moved steplessly in an axial direction wherein the axial direction equals one of a depth of the hollow region and a death of a removal oath of the cap from the small bottle or equals the sum of both paths.

4. The small bottle as claimed in claim 1, wherein the actuating end of said removal element is embedded into a recess in the cap which does not point in the direction of the small bottle.

* * * * *